US008734926B2

(12) United States Patent
Lenz et al.

(10) Patent No.: US 8,734,926 B2
(45) Date of Patent: May 27, 2014

(54) PLASTICS TRANSPORTING CONTAINER FOR TRANSPORTING AND/OR STORING ARTICLES AND THE LIKE

(75) Inventors: Thorsten Lenz, Berlin (DE); Oliver Orset, Sainte Julie (FR); Herman Gommer, Schoonebeek (NL)

(73) Assignee: Schoeller Arca Systems GmbH, Schwerin (DE)

( * ) Notice: Subject to any disclaimer, the term of this patent is extended or adjusted under 35 U.S.C. 154(b) by 396 days.

(21) Appl. No.: 13/321,241

(22) PCT Filed: Apr. 22, 2010

(86) PCT No.: PCT/EP2010/002482

§ 371 (c)(1),
(2), (4) Date: Nov. 28, 2011

(87) PCT Pub. No.: WO2010/136098

PCT Pub. Date: Dec. 2, 2010

(65) Prior Publication Data

US 2012/0061278 A1 Mar. 15, 2012

(30) Foreign Application Priority Data

May 28, 2009 (EP) ..... 09007147

(51) Int. Cl.

| | |
|---|---|
| ***B29D 22/00*** | (2006.01) |
| ***B29D 23/00*** | (2006.01) |
| ***B32B 1/08*** | (2006.01) |
| ***B60R 21/16*** | (2006.01) |

(52) U.S. Cl.
USPC ..... 428/36.1; 428/34.1; 428/35.7; 428/36.3; 206/524.3

(58) Field of Classification Search
USPC ..... 428/35.7, 34.1, 36.1, 36.3; 206/524.3
See application file for complete search history.

(56) References Cited

FOREIGN PATENT DOCUMENTS

| | | |
|---|---|---|
| CN | 2060723 | 8/1990 |
| DE | 14 79 899 A1 | 5/1969 |
| DE | 4039058 | 11/1994 |
| DE | 20320519 | 9/2004 |
| GB | 899 435 A | 6/1962 |

OTHER PUBLICATIONS

International Search Report prepared by the European Patent Office on Jul. 7, 2010 for International Application No. PCT/EP2010/002482.

Official Action (English translation) for Chinese Patent Application No. 201080023629.8 dated Mar. 28, 2013, 7 pages.

*Primary Examiner* — Michael C Miggins
(74) *Attorney, Agent, or Firm* — Sheridan Ross P.C.

(57) ABSTRACT

The present invention relates to a plastics transport container for transporting and/or storing articles, having a container base (14) and side walls (2, 3) which are circumferentially arranged at the base of the container. Thus, it is provided that at least one flat section of the thin-walled container with a thickness ranging from 1.4 mm to 4 mm is reinforced by a braided or woven structure of fibers (4) embedded in the surface or proximal to the surface of the section.

17 Claims, 5 Drawing Sheets

PLASTICS TRANSPORTING CONTAINER FOR TRANSPORTING AND/OR STORING ARTICLES AND THE LIKE

CROSS REFERENCE TO RELATED APPLICATIONS

This application is a national stage application under 35 U.S.C. 371 of PCT Application No. PCT/EP2010/002482 having an international filing date of 22 Apr. 2010, which designated the United States, which PCT application claimed the benefit of European Patent Application No. 09007147.3 field 28 May 2009, the entire disclosure of each of which are hereby incorporated by reference.

The invention relates to a transport container made from plastic material according to the preamble of patent claim 1.

Transport containers of this type are typically made from thermoplastic materials through injection molding, wherein preferably polypropylene or polyethylene are being used. Transport containers of this type have a base and four circumferentially arranged side walls which are either integrally and thus permanently connected with the base or configured foldable so that the side walls are foldable onto the base in order to save shipping volume when the containers are shipped back empty.

Containers according to the invention are transport containers with a plan view size of 60 cm length and 50 cm width at the most, which are configured with respect to their sizes so that they can be carried manually, thus also when receiving loads. A typical application for a transport container of this type is a bottle crate for receiving beverage bottles. Containers of this type for receiving loads which are being transported manually have to be configured as light as possible, considering that a crate for receiving e.g. 12 one-liter water bottles in addition to the crate weight has to support a load of approximately 12 kg. As a matter of consequence, this impacts the thickness of the container walls and of the base in case they are configured accordingly stiff in order to be able to receive loads of this type. Therefore, there are certain limits to reducing the container walls and a reduction of the thickness beyond a critical range typically requires a special material selection which in turn makes the crates more expensive. On these grounds, crates of this type are typically provided with ribs and similar in order to increase strength which, however, degrades the outward appearance of a crate of this type.

Though it is already known for containers to configure a container wall from two plastic materials (German utility model DE 203 20 519), wherein the container wall includes a rib-shaped structure configured as an insertable component which is encased by injection molding of an additional plastic material. This also achieves a stiffening of the container wall, however this does not facilitate forming extremely thin walled container walls. Furthermore, insertable components of this type are primarily used in an arrangement about a handle opening, but not for configuring an overall container wall, since this would lead to a comparatively thick container wall configuration and thus to a comparatively heavy container.

Additionally, GB 899 435 illustrates a crate including side walls, a base and spacers for inserting bottles and similar which is produced through an injection molding method. Thus, reinforcing fiber material, e.g. glass fiber by itself or mixed with a paper mass can be introduced into the injection mold.

Furthermore, a transport container is known from DE 40 39 058 C2 in which an insertable component is provided in the portion of the handle opening like in the prior art recited supra, wherein the insertable component is supported with pins in an injection mold and integrally encased by the other plastic material. Thus, the stiffness of the portion about the handle opening is increased. Also this prior art has the disadvantages recited supra.

Thus, it is an object of the invention to provide a transport container in particular for manual transportation, wherein the transport container is characterized by a lightweight and stiff configuration.

This object is achieved according to the invention through the features included in the characterizing portion of claim 1, wherein advantageous embodiments of the invention are provided by the features recited in the dependent claims.

According to the invention, the container includes at least one flat section, preferably plural flat sections, which is/are reinforced through a structure that is embedded in a portion of the respective section that is proximal to the surface or the structure is embedded at the surface, wherein the structure is formed from fibers, a braided material or a woven material. Thus, the flat section or the flat sections of the container are configured very thin and have a thickness in a range of 1.4 mm to 4 mm. This yields a very lightweight structure for a transport container of this type which, however, is characterized by rather high stiffness and which is also accordingly stable under high loads, this means stiff against deformation. Simultaneously, this reinforcement also yields increased fracture resistance and impact resistance of a transport container of this type.

Preferably, the flat section is respectively formed by a side wall and/or the base of a container so that the flat section substantially represents the side wall of the container. This is the case substantially because in such containers typically the upper and the lower edge and also the corner portion are configured with greater thickness. Thus, it is preferred that the flat section is pulled as close as possible to the upper and lower edges and also into the corner portion. However, the side wall can also be reinforced with the structure or similar structures in plural flat sections arranged adjacent to one another and/or above one another.

A portion proximal to the surface according to the application means that embedding of the structure is provided in a depth of 0.1 to 0.5 mm, preferably 0.1 to 0.4 mm. Preferably the thickness of the flat section or the side wall is 1.7 to 3 mm, particularly preferably 1.8 to 2 mm. Advantageously, the portion of the section proximal to the surface has 25% of the thickness of the flat section or the thickness of the side wall, preferably 20%, particularly preferably 15%. This means the transport container is characterized by very thin walled flat sections or container walls, wherein the structure made from fibers, woven or knitted material is embedded proximal to the surface and even forms a portion of the surface when embedded accordingly. The latter measure has the advantage that the structure then becomes a portion of the outer surface of the side wall itself which simultaneously facilitates a design component for configuring the bottle crate. Thus, the structure can be formed from a denim cloth or a respective woven or knitted material which then has the consequence that the fabric reinforced side wall also includes a denim cloth design or similar on the outside.

The structure itself can be made from fibers with an identical or different configuration and orientation or from a knitted material including fibers. A glass fiber woven material, glass fiber fleece or a glass fiber web which is configured extremely thin-walled is particularly suitable. For fibers besides glass fibers, also carbon fibers, aramide fibers, thermoplastic fibers, textile fibers and similar are suitable. Alternatively, also a structure made from fine wire grid or wire mesh is feasible.

Advantageously, the structure is formed by a plastic foil which can also be arranged in multiple layers, wherein the fibers, the woven or knitted material, can either be embedded within one of the foils or between the foil layers. For this purpose in particular also thermoplastic materials and elastomeric materials are suitable.

Subsequently, preferred embodiments of the invention are described with reference to a drawing, wherein.

Figure 1:
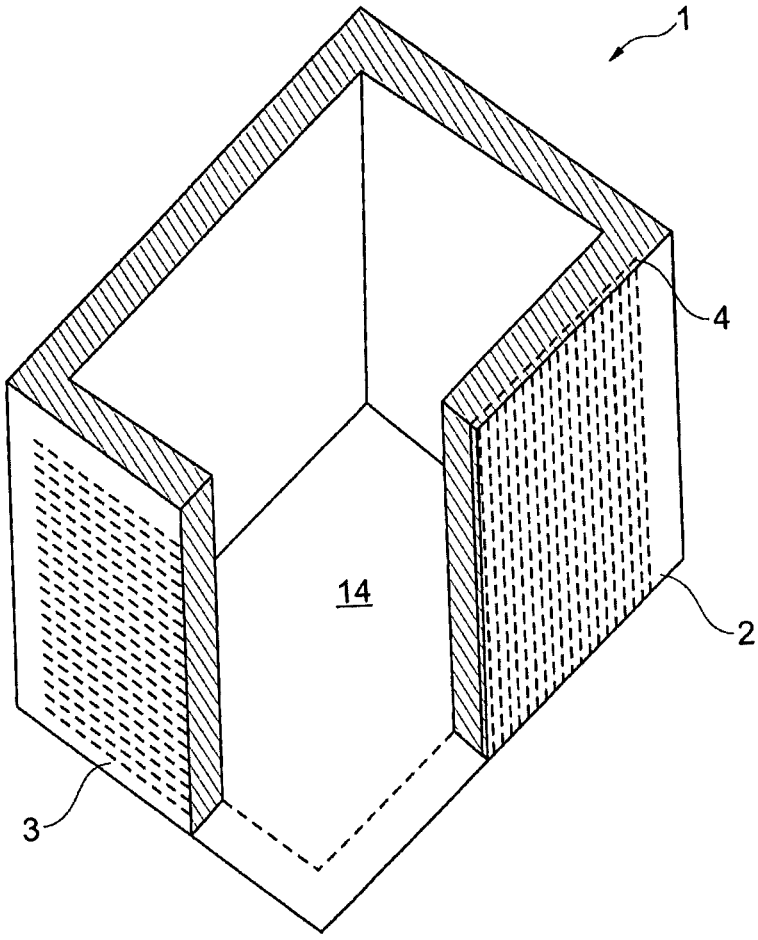
FIG. 1 illustrates a horizontal and a vertical sectional view of a first embodiment of a transport container with plural flat sections.

FIG. 1 illustrates a perspective and schematic view of a container generally designated with reference numeral 1 which in this case has four circumferentially arranged side walls, wherein both of the forward side walls that are oriented towards a viewer are designated with the reference numerals 2 and 3. The base at which the four side walls are integrally formed is designated as 14. The container illustrated in FIG. 1 is made from a suitable plastic material through injection molding.

As evident from FIG. 1, fibers 4, thus a plurality of fibers 4, are embedded in the side walls of the container, in particular encased, wherein the fibers in the embodiment according to FIG. 1 are arranged substantially parallel to one another. This configuration is illustrated in FIG. 1 with the right side wall designated with the numeral 2; this means at least a flat section of the side wall 2 is provided with fibers embedded in the plastic material of the container 1. In the illustrated embodiment, the flat section with the embedded fibers extends substantially over the entire side wall 2 besides the lower edge illustrated in FIG. 1, the corner portion and the upper container portion that is not visible in FIG. 1 due to the horizontal sectional view. Thus, the surface section with the embedded fibers is preferably pulled far into the upper and lower edge and into the corner portion. Typically in transport containers of this type as long as they are stackable, the upper and the lower edge is configured thicker than the remaining side wall for the stacking engagement.

Also the side walls of the transport container are configured very thin, which is not clearly apparent from the schematic illustration in FIG. 1 and from the other illustrated embodiments. In the illustrated embodiment, the thickness of the side wall is 2.2 mm. In the schematic illustration, the thickness of the side wall is, however, illustrated in an exaggerated manner in order to be able to illustrate the configuration overall in a better manner.

FIG. 1 also illustrates a flat section for the left side wall which includes embedded fibers 4, however, in a horizontal orientation, this means parallel to the lower or upper container edge, in order to illustrate that the fibers are embedded in vertical and also in horizontal direction in the side walls. It is appreciated that in the same transport container, preferably fibers are arranged in the same orientation, thus either vertically or horizontally. Also an alternative orientation, e.g. diagonal is within the scope of the invention.

Figure 2:
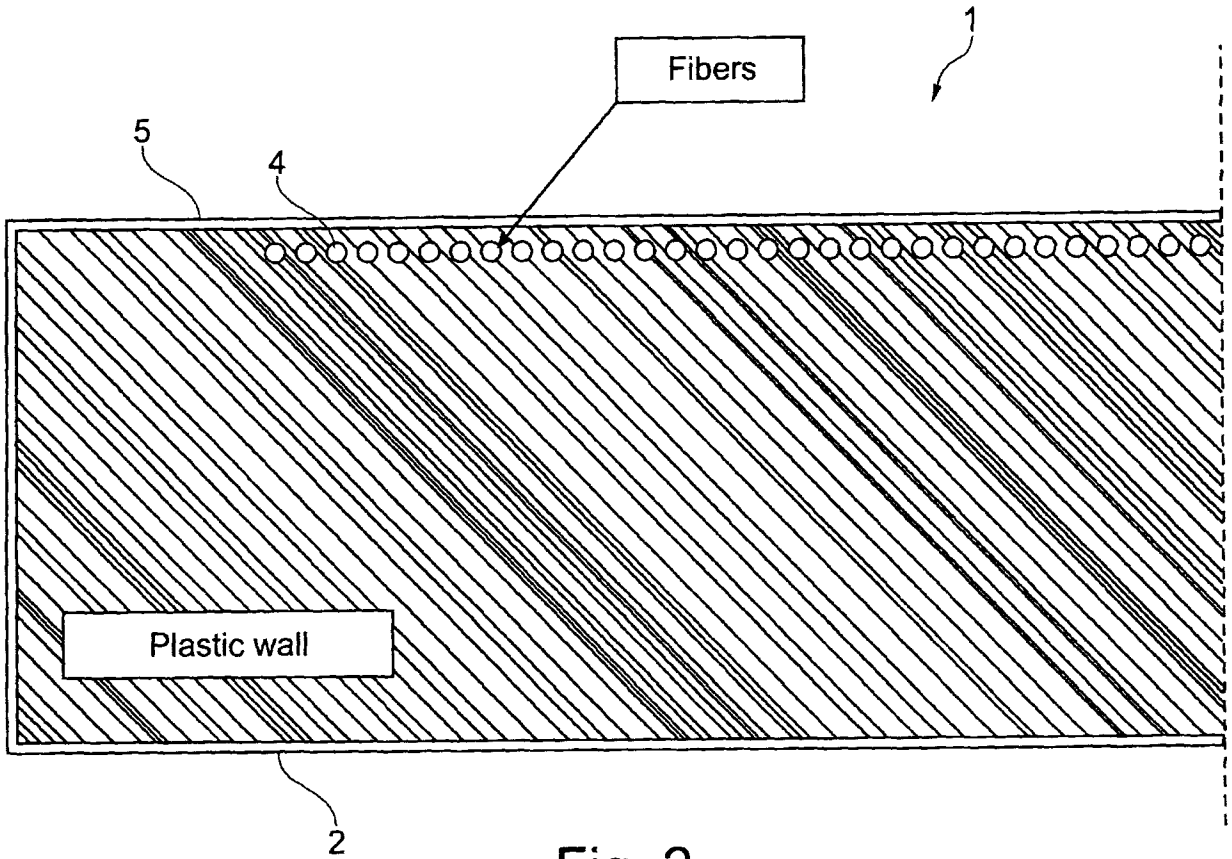
FIG. 2 illustrates an enlarged sectional view through a side wall of the container illustrated in FIG. 1.

From the partial sectional view of FIG. 2, it is apparent that the structure including embedded fibers 4 is arranged in a portion of the flat section or of the side wall 2 that is proximal to the surface and the structure is configured from a plurality of closely spaced fibers, wherein the structure is embedded according to FIG. 2 in the portion of the plastic material of the container 1 that is proximal to the surface. This means the structure made from fibers 4 is arranged according to FIG. 2 at a distance from the outer surface 5 of the side wall 2, thus overall surrounded by the plastic material of the container. In the illustrated embodiment, the flat structure including fibers arranged at a close distance from one another is disposed at a distance of 0.2 mm from the outer surface 5 of the side wall 2, but not at a greater depth than 0.6 mm at the most.

As apparent from the description provided supra, a portion proximal to the surface means that the structure made from fibers has a distance from the outer surface of the side wall in a range of preferably 0.1 to 0.5 mm, particularly preferably 0.1 to 0.4 mm, wherein as already recited supra, the thickness of the flat section, this means the thickness of the side wall is not more than 4 mm, in particular it is in a range of 1.4 to 3 mm and particularly preferably in arrange of 1.8 to 2 mm.

Figure 3:
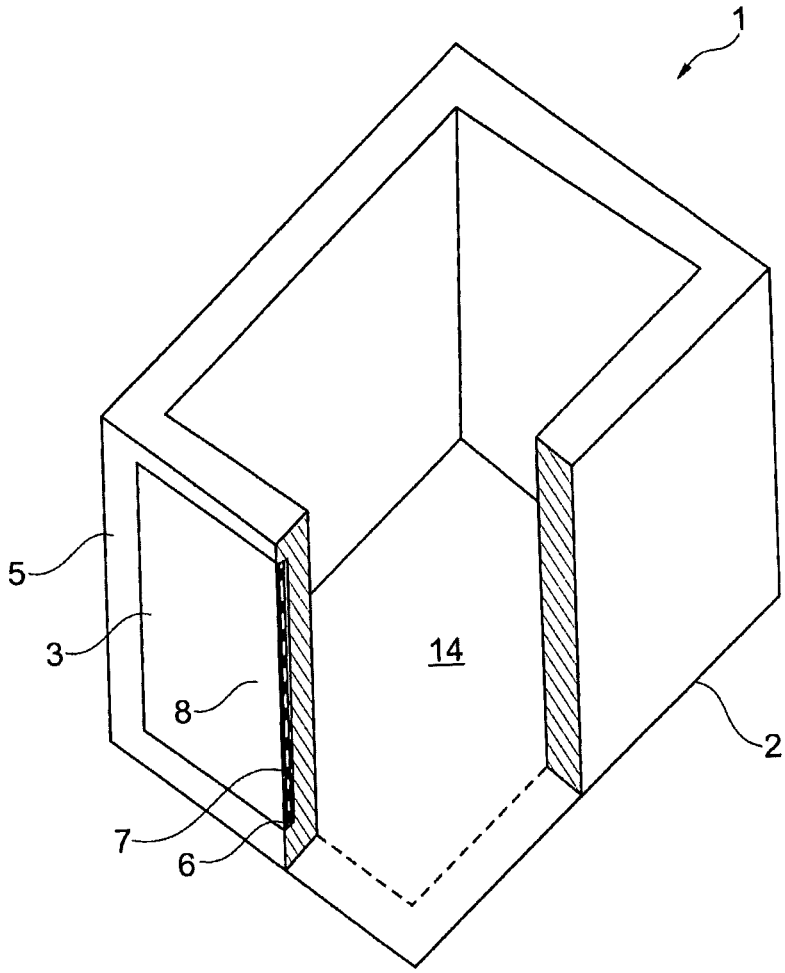
FIG. 3 illustrates a purely schematic perspective view of another embodiment of a container with vertical cross-sections.

In the embodiment according to FIG. 3 in which in turn a container is illustrated in a perspective view, the side walls of the container 1 include flat sections, wherein a structure including fibers 7 embedded in a foil 6 is provided at the surface of the flat sections. In FIG. 3, this foil 6 is only illustrated in the left side wall 3, however the foil is preferably also arranged at the other side walls. The structure 8 including the foil 6 with fibers 7 embedded therein is illustrated more clearly in FIG. 4.

Figure 4:
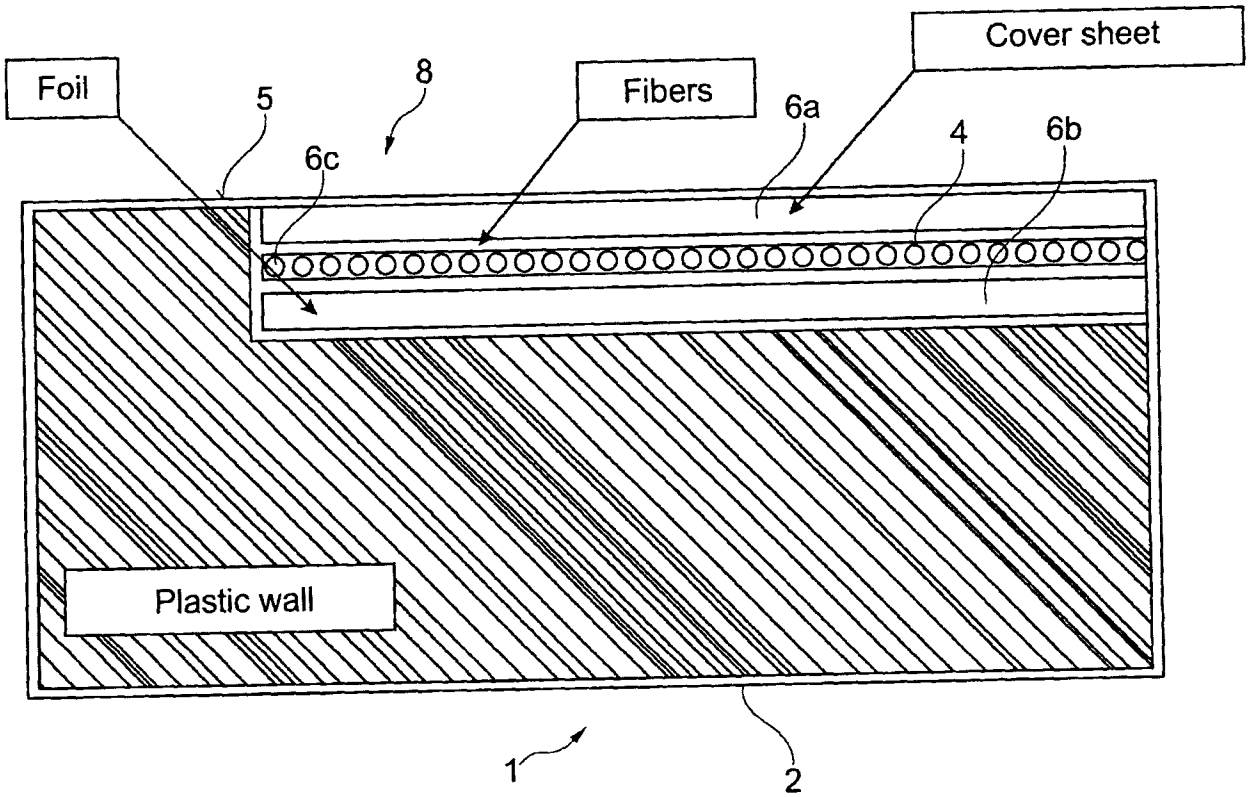
FIG. 4 illustrates an enlarged partial sectional view of a side wall of the container according to FIG. 3.

FIG. 4 illustrates that the foil 6 also forms a portion of the outer surface 5 of the container, thus is in particular aligned flush with the lateral connecting sections of the container 1. This means the structure 8 is embedded in the plastic material of the container 1 but only surrounded by plastic material on three sides in a sectional view, wherein the outer surface of the foil 6 is simultaneously forms a portion of the outer surface of the side wall 2. In the embodiment according to FIG. 4, thus the foils are approximately centrally arranged within the foil 6. The foil 6 can be configured integrally in one piece, wherein a plurality of fibers, preferably in the same direction, is embedded in the foil during the production process of the foil, however the foil as illustrated in FIG. 4 can be configured from plural layers, namely an outer layer 6*a* and an inner layer 6*b* and a center layer 6*c* which includes the fibers. The foil 6 thus extends from the outer surface 5 of the side wall 2 in inward direction over a depth of 0.3 mm.

Though the structure is configured from unidirectionally oriented fibers in the embodiments of FIGS. 1 and 3, however, the structure can alternatively also be formed by a fiber woven contexture. In particular, a glass fiber fleece or a glass fiber cloth are particularly suitable. For materials for the fibers, and thus also for the fiber woven materials, fiber knitted materials and similar, glass fibers, carbon fibers, aramide fibers, thermoplastic fibers, textile fibers and similar are suitable. The container itself is typically injection molded from polypropylene or polyethylene, wherein also other suitable materials can be used depending on the application of the transport container.

Figure 5:
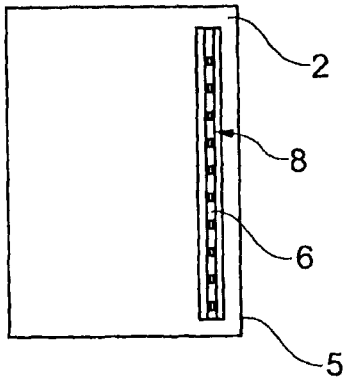
FIG. 5 illustrates a partial sectional view of a container in another embodiment.

As an alternative to the embodiment according to FIG. 4, FIG. 5 illustrates a structure 8 including a foil with fibers, fiber woven material or fiber knitted material provided therein which, however, is arranged herein in a portion proximal to the surface, this means embedded into the plastic material of the container 1 so that differently from the embodiment according to FIG. 4, the structure 8 or the foil 6 does not form the outer surface of the side wall 2. Actually, the structure 8 is completely embedded in the side wall, however in the portion proximal to the surface, thus at a depth of 0.3 mm in turn, wherein the distance between the surface of the structure 8 that is oriented to the outer surface and the outer surface of the side wall is 0.1 mm. Also in the embodiment according to FIG. 5, like in the embodiment according to FIG. 3, the thickness of the side wall is 2 mm. As an alternative to the fiber structure described supra, the structure 8 can also be formed from a fine wire knitted material, which is configured fine enough so that it is completely embedded in the portion of the plastic material that is proximal to the surface.

Figure 6:
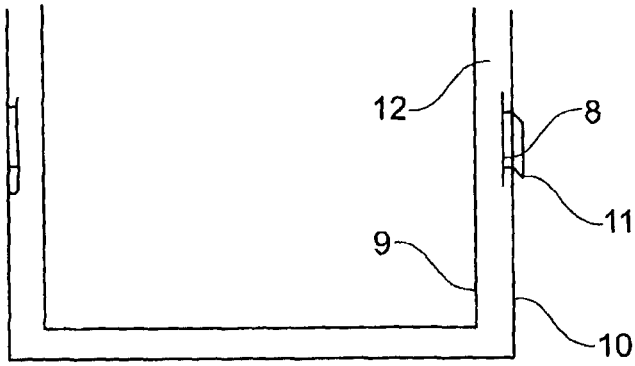
FIG. 6 illustrates a schematic lateral view of an injection mold.

FIG. 6 illustrates the formation of a container with the structure embedded in the portion proximal to the surface, wherein the inner mold wall is designated as 9 and the outer mold wall is designated as 10 in a schematically illustrated injection mold. The structure 8 including fibers, fiber woven material or fiber knitted material is arranged at a small distance from the mold wall 10, wherein the structure 8 is received by support mandrels 11 and fixated within the cavity of the mold. Certainly also other attachment options are feasible as long as they are suitable, which does not have to be described in more detail herein. In case the structure 8 is arranged in the surface portion, the structure 8 can also be supported by a vacuum or can be supported electrostatically at the mold wall 10 as it is done for in mold labels (IML). When plastic material is injected into the mold cavity 12, then the fiber knitted material supported at a small distance from the mold wall 10 by the support mandrels is encased through injection molding on all sides and thus embedded in the portion of the plastic container that is proximal to the surface.

In the illustrated embodiments, the flat section is formed essentially through the entire side wall itself. However, it is also within the scope of the invention that only flat sections, this means plural sections of a side wall of the container that are arranged adjacent to one another and/or above one another are provided with the structure 8. This is the case in particular when the container is configured as so-called display container, thus has larger openings, so that the interior of the container and thus the goods received therein, in particular bottles for a bottle crate are visible from the outside. The flat section can also be part of the base or can be formed by the base. Thus, it can also be helpful when the structure extends from the base into the side wall and vice versa, so that also the transition from the base into the side walls is reinforced accordingly.

The invention claimed is:

1. A transport container made from plastic material for transporting and/or storing goods, comprising a container base and side which are circumferentially arranged at the base of the container, wherein the transport container is reinforced through an embedded structure made from fibers or similar, wherein at least one flat section of the thin walled container with a thickness in a range of 1.4 mm to 4 mm is reinforced by the structure made from fibers, a braided material or a woven material, wherein the structure is embedded in a portion of the section that is proximal to the surface or at the surface of the section.

2. The transport container according to claim 1, wherein the flat section is formed by a side wall and/or the base of the container.

3. The transport container according to claim 1, wherein the flat section, in particular the side wall and/or the base has a thickness in a range of 1.7 mm to 3 mm, preferably 1.8 mm to 2 mm.

4. The transport container according to claim 1, wherein the portion of the section that is proximal to the surface includes 25% of the thickness of the section, preferably 20%, particularly preferably 15%.

5. The transport container according to claim 1, wherein the portion proximal to the surface has a distance from an outer surface of the side wall with a depth of 0.1 to 0.5 mm, preferably 0.1 to 0.4 mm.

6. The transport container according to claim 1, wherein the embedding depth is 0.5 mm at the most, preferably 0.1 to 0.4 mm.

7. The transport container according to claim 1, wherein the thickness of the structure is between 0.1 and 1 mm.

8. The transport container according to claim 1, wherein the structure includes a plastic foil into which the fibers, the woven material or the braided material is embedded.

9. The transport container according to claim 1, wherein the structure is directly embedded in the flat section.

10. The transport container according to claim 1, wherein the structure is formed from glass fibers, carbon fibers, aramide fibers, thermoplastic fibers or textile fibers.

11. The transport container according to claim 1, wherein the structure is formed from a glass fiber cloth, glass fiber fleece or glass fiber grid material.

12. The transport container according to claim 1, wherein the structure is formed from a wire grid or wire woven material.

13. The transport container according to claim 1, wherein the container is injection molded from thermoplastic materials, preferably polypropylene (PP) or polyethylene (PE).

14. A method for producing a transport container according to claim 1, wherein a structure including fibers, a knitted material or woven material for reinforcing the flat section of the container is introduced into a cavity of an injection mold for forming the section and supported at a mold wall and plastic material is subsequently injected into the mold cavity.

15. The method according to claim 14, wherein the structure is supported at a distance from the mold wall.

16. The method according to claim 14, wherein the structure is supported so that it directly contacts the mold wall.

17. The method according to claim 14, wherein support for the structure in the mold cavity or at the mold wall is provided through support pins, support mandrels or grooves introduced into the mold wall at which the structure is attached and/or wherein the support is provided through vacuum and/or electrostatic charging.

* * * * *